US006752396B2

(12) United States Patent
Smith

(10) Patent No.: US 6,752,396 B2
(45) Date of Patent: Jun. 22, 2004

(54) METHOD AND SYSTEM FOR PLAYING TRIVIA GAMES

(76) Inventor: Tommy R. Smith, 5025 Burma St., Houston, TX (US) 77033

( * ) Notice: Subject to any disclaimer, the term of this patent is extended or adjusted under 35 U.S.C. 154(b) by 0 days.

(21) Appl. No.: 10/202,528

(22) Filed: Jul. 24, 2002

(65) Prior Publication Data

US 2004/0017044 A1 Jan. 29, 2004

(51) Int. Cl.[7] ..... A63F 9/18
(52) U.S. Cl. ..... 273/429; 273/432
(58) Field of Search ..... 273/429, 430, 273/431, 432

(56) References Cited

U.S. PATENT DOCUMENTS 5,513,852 A * 5/1996 Robinson ..... 273/431
6,394,899 B1 * 5/2002 Walker ..... 463/9
6,443,840 B2 * 9/2002 Von Kohorn ..... 463/17

* cited by examiner

*Primary Examiner*—William M. Pierce
(74) *Attorney, Agent, or Firm*—Darcell Walker

(57) ABSTRACT

The present invention is a timed trivia game. This game has two rounds. During the standard round each time a question is asked the contestant will this designated amount time to respond. If the contestant responds in less than the designated time, the remainder of the time designated to answer the question will be calculated and saved. At the end of the standard round all of the remaining time from the questioned will be calculated. This calculated time will be the amount of time in the speed round for that particular contestant or team. During the speed round, that contestant or team will have the opportunity to answer as many questions as the time allows. The correct answers from this round will be added to the score from the standard to determine the final score for that contestant or team.

3 Claims, 1 Drawing Sheet

METHOD AND SYSTEM FOR PLAYING TRIVIA GAMES

FIELD OF THE INVENTION

The present invention relates to a format and method for playing trivia question games and particular to a format and method in which a player or team's total score can be substantially affected by the amount of time a player takes to correctly answer the questions during the game.

BACKGROUND OF THE INVENTION

Various trivia games testing the knowledge and/or skill of the players have been known for centuries. Trivia board games appear to be the most common form of trivia game. More recently, games involving the testing of trivial knowledge (e. g., Trivial Pursuit™) have become popular. Generally, the subject of such trivia games falls within historical information, broken into categories such as sports, theater, national histories and other names, events and places having some significance in past history. Differing categories of subject matter may be selected by random selection devices or by intentional choice of the player. Such games generally involve a peripheral or other playing path described over a portion of the board, with the playing path being common to all players. Players advance position markers along the playing track according to the degree of success of each in correctly responding to randomly selected questions, usually contained in a deck of question and answer cards. A winning condition exists when the player has traversed a given player movement track.

The results of such a game are generally straightforward, with players having a greater knowledge in the given subject or field of the game, almost always winning the game. Each player's fate is in his or her own hands in such a game, and there is nothing any of the other players can do to alter the course of success of such a superior player. Once such a player approaches the end point of the game, the result is a foregone conclusion.

Other board game formats have a question and response format with rules or procedures allowing players to retard or set back the progress of other players, under certain circumstances of play. In U.S. Pat. No. 6,267,376, the board game is played on a board having a series of parallel playing paths thereon, with each player using a single one of the paths. The winning player is the first to move one's position marker from one end of the board (or path) to the other, in accordance with the rules. Opposing players may restrict or reverse the progress of a player by correctly answering a question, preferably at a higher level of difficulty, and choosing to move the player's marker back rather than advancing their own marker. An incorrect response results in the corresponding position marker being set back a corresponding number of positions, depending upon the level of difficulty of the selected question. While the present game may be played using questions from virtually any subject area, it is particularly directed to the use of trivia questions based upon television programs, and more particularly upon current or past situation comedies ("sitcoms").

In U.S. Pat. No. 5,042,816 issued on Aug. 27, 1991 to Tracy L. Davis et al., titled "Biblical Question And Answer Game," describes a game having a game board with a peripheral path and at least one crossing path, unlike the game board of the present invention. Davis et al. provide different groups of cards, unlike the present game. One group has plural questions on each card, but the questions are selected by chance means and do not differ in difficulty, as do the present cards. Moreover, Davis et al. do not provide means to set back the progress of an opposing player.

U.S. Pat. No. 5,152,535 issued on Oct. 6, 1992 to Adolph Roberts, titled "Bible Quiz Game," describes a game having a game board with playing paths of different levels of difficulty. Players select the level of difficulty desired at the beginning of the game and are restricted to that level throughout the game, rather than being allowed to select a question of a certain level of difficulty at each turn, as in the present game. "Freeze" cards are provided for a player to restrict an opponent from advancing, but this differs from the present game in that (1) the "freeze" cards may only be used against an opponent positioned on one of the penultimate positions of the game board paths, and (2) no means is provided for setting back the position of an opposing player.

U.S. Pat. No. 5,607,160 issued on Mar. 4, 1997 to Arthur J. Stevens et al., titled "Three Talent Board game," describes a game having a triangular board with intersecting arcuate playing paths thereon. The playing paths are divided into a series of three different types of positions, requiring teams of players to answer a series of three questions, draw representations of three different articles, or act out representations of three different words, depending upon the position. Chance means is used to determine the number of positions to be moved on each team's turn, unlike the present game in which the distance advanced is determined according to the difficulty of the question selected by the player. Stevens et al. provide no means for setting back the progress of a player in the event of an incorrect response, and/or for setting back the progress of an opponent if a first player responds correctly to a question at a predetermined level of difficulty.

In addition to popular board games, many of trivia games can be played in situations where the contestants do not move around a board or path. Games played on television do not facilitate the movement of contestants. These games involve a contestant or team answering questions and accumulating points based on correct answers. Usually a contestant has a specific amount of time to answer the presented question. Some of these games have various categories of questions with different degrees of complexity. More points are awarded for answering a more complex question.

It is desired to have a trivia game that combines some of the characteristics of traditional board games and of some television quiz and games shows.

SUMMARY OF THE INVENTION

It is an objective of the present invention to provide a format and method of playing a game that can education the contestants about the particular subject that is covered by facts in the questions being asked during the course of the game.

It is a second objective of the present invention to provide a trivia game in which the contestant or teams pre-select the pool of questions from which the questions asked during the game will be selected.

It is a third objective of the present invention to provide a format and method for playing a game in which the contestants have a set time period to answer a question.

It is a fourth objective of the present invention to provide a format and method for playing a game in which there is a standard question-answering round and a speed question-answering round.

It is a fifth objective of the present invention to provide a format and method for playing a game that determines the amount of time in the speed round based on the amount of time used by the contestants to answer questions in the standard round.

The format of the present invention comprises a set of pre-selected questions, a means to ask questions of the contestants, a time-keeping means and a means to calculate excess time from the answered questions and a scorekeeper. In the process of the present of the present invention, each contestant or team can pre-select a number of questions from a question pool. These questions will be comprised into the game question list. The questions asked during the game will come from this pre-selected list of questions. The game format can have one round or there can be at least rounds of questions. In the two round format, there can be a standard question answering round and a speed question answering round. A set amount of time can be designated to answer each question. During the standard round, each time a question is asked the contestant will this designated amount time to respond. If the contestant responds in less than the designated time, the remainder of the time designated to answer the question will be calculated and saved. At the end of the standard round all of the remaining time from the questioned will be calculated. This calculated time will be the amount of time in the speed round for that particular contestant or team. During the speed round, that contestant or team will have the opportunity to answer as many questions as the time allows. The correct answers from this round will be added to the score from the standard to determine the final score for that contestant or team. This format will encourage prompt but accurate answers from the contestants.

DETAILED DESCRIPTION OF THE INVENTION

Figure 1:
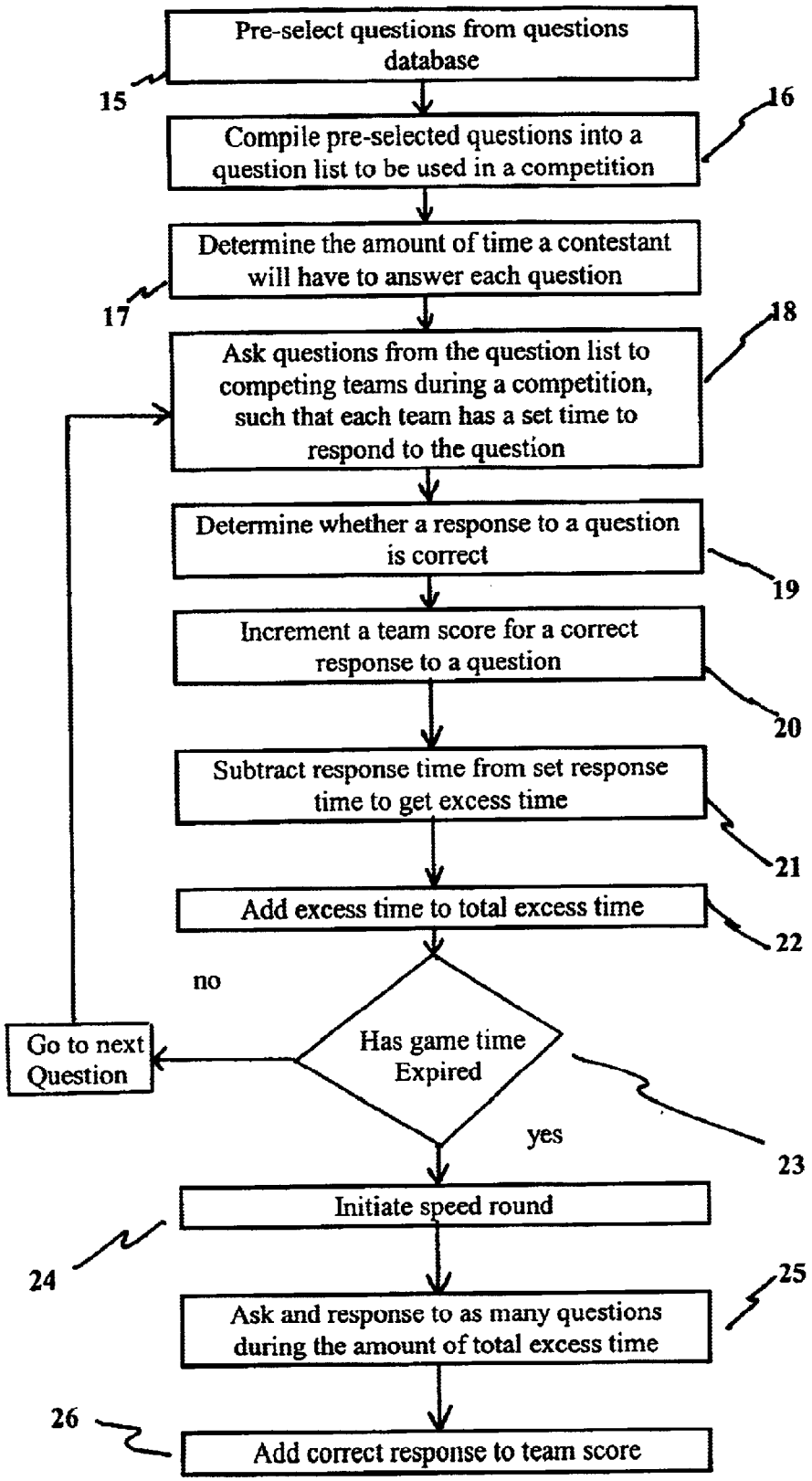
FIG. 1 is a flow design of the steps involved in playing a game in accordance with the present invention.

The present invention describes a format and method for playing games where contestants answer questions on various topics. In this game, the contestants can be individuals or teams. The number of contestants can vary and can be one, two or more. The general configuration of game comprises various components, which include a questioner that poses the selected questions to the various contestants. A second component is a timekeeper that tracts the amount of time a contestant takes to answer a question. The third component is a scorer that maintains an accumulation of the score for a contestant.

FIG. 1 is an illustration of the sequence of steps performed in the playing of a game in accordance with the present invention. Prior to the playing of a game, there is the creation of a database of questions. This process is necessary in creation of any board game or trivia game. Depending on the desires of a game designer, the questions can cover various topics or cover only a specific topic. For the purposes of explaining the method of the game in the present invention, the topic covered by the game will be history and in particular African-American history. The questions can be categorized according to complexity or all of the questions can have the same complexity. The questions can be all have the same weight or different weights again according to complexity. In the present example, the questions will be profiles of African-Americans. Each of these profiles will have the same complexity. The number of questions in the data has to be sufficient to enable the contestants to have a broad selection of questions from which to choose. In an example, the question database may have 500 hundred questions.

Referring to FIG. 1, once the question database has been completed, in step 15, each contestant/team will select a predetermined number of questions from the question database. For example, if there are two teams, each team may select 50 questions from this database. The contestants can mutually agree to this number questions to select or the game administrator can make this determination. Step 16 compiles the selected questions into a pool of questions for the game. These 100 selected questions would comprise the pool from which the questions will be asked during the game. Each contestant will have the list of questions in the database. Each contestant will select questions without the knowledge of the questions selected by the other contestant. As a result, there may be some overlap in the questions selected by the contestants. In the case of overlap, a game administrator or another game official, the questioner, timekeeper of scorer could select questions to replace any duplicated questions. In the alternative, it is not necessary to replace duplicated questions. In this case, the game could proceed with fewer questions. Step 17 determines the amount of time allotted to answer each question. Each question could require the same amount of time or the amount of time could vary based on the complexity of the question. In the present example of the African-American profiles each question will require the same amount of time to answer. The simplest implementation is to have questions that require the same amount of time to answer. Because of the format of this game, having questions with varying amounts of time will require additional game rules.

The next step in the process is to play the game in step 18. In this step, the questions could be asked in an alternating manner between contestants. An alternate method would be to ask one team all of their questions and then ask the other team all of their questions. The preferred method is to ask questions of the contestants in an alternating manner. There can be a predetermined number of questions that can be asked of each team or contestant. For a team comprised of five players, there may be a determination to ask 25 questions representing five questions for each team member. Each question may have a response time allotment of 15 seconds. In this case, the allotment of time for the total number questions would be 6 minutes and 15 seconds. Each team will have this total amount of time. In the actual playing of the game, a contestant is asked a question from the pre-selected list. The time for the contestant to response to the question to will then start. When the contestant answers the question, the response time will stop.

In step 19, there is a determination whether a response to the question is a correct answer. If the response is the correct answer, the contestant/team is awarded points based on this correct answer. These points are added to the contestant score in step 20. In step 21, there is a determination of any remaining time left from the allotted time to answer the question. If there is additional time left from the allotted time, this additional time is added to time allotment for that contestant. In an example, if a contestant only needed 10 seconds to answer a question, this response would leave five seconds remaining. This five seconds would be stored in the time allotment for that contestant. Step 21 performs this operation. The time required to respond to the question is subtracted from the allotted time. Step 22 adds the remaining time for a question to the previous total remaining time and stores the calculated excess or remaining time. Steps 18 through 22 are repeated for each question asked of a contestant.

As previously mentioned, in this embodiment, there are a predetermined number of questions that will be asked of the contestants in this round of the game. Step 23 determines if the contestants have been asked this predetermined number of questions. If the answer is no, the game returns to step 18 and a contestant is asked another question in accordance with the steps of the present invention. If the predetermined number of questions has been asked, the game proceeds to the speed round in step 24.

In the speed round, each contestant or team if there are multiple contestants on one team will have the opportunity to answer as many questions as they can in the time allotted in the speed round. The amount of time allotted in the speed round will be the remaining to time saved from the responses in the just-completed standard round. For example, if the excess time was 120 seconds, this time would be the amount time for that team in the speed round. In the speed round, in step 25, the contestant would be asked a series of questions from the same predetermined question list as in the standard round. Each time the contestant correctly answers a question, in step 26 points are added to the total accumulated score for that contestant. This process will exist for each contestant or team in the game. The winning contestant will be the one with the highest accumulated score at the end of the speed round.

Referring to step 15 of FIG. 1, in the processes of dialogues during trivial contest, there are many subject areas, which can be listed by "reference numbers" which are components to the totality of a particular message or point of view. In order to get an understanding of the message, one must understand each component of the sequence of reference numbers, which tells the complete story. Therefore, the contestant should select a sequence of reference numbers trivial facts of the whole, which reveals the total essence of the story.

Among the listings of names, significant dates and historic events are other subject matters, which may be used in this trivial contest are incorporated into these games by selecting "reference numbers of particular dialogues and discourses and addressing the body of the message given through those trivial facts 100 reference trivial facts in relations to the whole sequence of reference numbers. Through these processes of limitation, the complete essence of the dialogue may be comprehended and explained in relation to the whole sequence of reference numbers selected. On trivial facts, which do not have a profile, if contestant selects a reference number the contestant may select all of their [100] "reference" numbers in proper sequence as to support the body of the dialogue/one wishes to address. The contestant may elect to enter certain reference numbers into the hopper that would aid him in his trivial questions.

In responding to a particular set of "reference" numbers, which is taken from the hopper or container the contestant should allow the contestant a period of time to acquaint oneself with the material the contestant has selected to be used in the trivial contest/and make application of those available trivial facts which is listed as his/her entry into the hopper.

At the conclusion or final period of the contest, the contestant may expound briefly three or four minutes period explaining the essence of the subject material or discourse in which the contestant has selected. After the contestant has selected [100] one hundred reference numbers, which are trivial facts toward the conclusion of that particular dialogue, the contestant should read or study the whole discourse, so as to be able t o proper address the trivial questions pertaining to the dialogue. The key to the proper processes of the trivial contest is to articulate the reference number selected in relation to subject matter of the complete dialogue.

The game can have many implementations. In a second embodiment, there could be only one round. Each contestant would be given a specific amount of time. This amount of time could depend on a variety of factors such as the projected number of questions that each side is expected to answer. This time amount could also be arbitrarily determined by a game administrator or agreed to by the contestants. Each contestant would answer as many questions as they could in that time period. As with the preferred, at time a question is answered, the amount of time required to answer the question would be deducted from the total amount of the designated time. With this approach a contestant is rewarded for prompt and correct answers by getting the opportunity to answer more questions and increase their score.

Individuals can implement this game in the same manner as other conventional board or television games. However, this game can be implemented in an automated form as well. In the automated form, individuals can play against other individuals without the need for the above-listed game format components of questioner, timekeeper and scorer.

It is important to note that while the present invention has been described in the context of a manual process, those skilled in the art will appreciate that the processes of the present invention are capable of being distributed in the form of instructions in a computer readable medium and a variety of other forms, regardless of the particular type of medium used to carry out the distribution. Examples of computer readable media include media such as EPROM, ROM, tape, paper, floppy disc, hard disk drive, RAM, and CD-ROMs and transmission-type of media, such as digital and analog communications links.

I claim:

1. A method for playing a trivia game comprising the steps of:

compiling a general pool of trivia questions;

selecting a first group of questions from the general pool of questions based on input from a first contestant;

selecting at least one next group of questions from the general pool of questions based on input from a next contestant;

combining the selected groups of questions to form the set of questions for use during the playing of a trivia game by the contestants selecting the groups of questions;

determining the total amount of time each contestant will have during the game to answer the questions asked of the contestant;

asking questions of the contestants, the questions being selected from the compiled list of questions;

subtracting the amount of time required to answer the question from the determined total amount of time that contestant has to answer questions;

adding points to the contestants total score for a correct answer to the asked question.

2. A method for compiling a set of questions for use during the playing of trivia games comprising the steps of:

compiling a general pool of trivia questions;

selecting a first group of questions from the general pool of questions based on input from a first contestant;

selecting at least one next group of questions from the general pool of questions based on input from a next contestant;

combining the selected groups of questions to form the set of questions for use during the playing of a trivia game by the contestants selecting the groups of questions;

implementing the combined set of questions during the playing of a trivia game.

3. The method as described in claim 2 wherein the number of questions in the combined set of questions is less than the number of questions in the general pool of questions.

* * * * *